US012559271B2

(12) United States Patent
Martin et al.

(10) Patent No.: US 12,559,271 B2
(45) Date of Patent: Feb. 24, 2026

(54) LOAD WRAPPING APPARATUS AND METHOD WITH SELF-BALANCING PAPER-BASED PACKAGING MATERIAL DISPENSER

(71) Applicant: Lantech.com, LLC, Louisville, KY (US)

(72) Inventors: Curtis W. Martin, Georgetown, IN (US); Jean-Louis Limousin, Louisville, KY (US); Michael P. Mitchell, Louisville, KY (US); Patrick R. Lancaster, III, Louisville, KY (US)

(73) Assignee: Lantech.com, LLC, Louisville, KY (US)

( * ) Notice: Subject to any disclaimer, the term of this patent is extended or adjusted under 35 U.S.C. 154(b) by 0 days.

(21) Appl. No.: 18/843,999

(22) PCT Filed: Dec. 15, 2022

(86) PCT No.: PCT/US2022/053035

§ 371 (c)(1),
(2) Date: Sep. 4, 2024

(87) PCT Pub. No.: WO2023/121949

PCT Pub. Date: Jun. 29, 2023

(65) Prior Publication Data

US 2025/0162742 A1 May 22, 2025

Related U.S. Application Data

(60) Provisional application No. 63/293,361, filed on Dec. 23, 2021.

(51) Int. Cl.

| | |
|---|---|
| ***B65B 41/16*** | (2006.01) |
| ***B65B 11/04*** | (2006.01) |
| ***B65B 57/04*** | (2006.01) |

(52) U.S. Cl.
CPC ..... *B65B 11/045* (2013.01); *B65B 41/16* (2013.01); *B65B 57/04* (2013.01)

(58) Field of Classification Search
None
See application file for complete search history.

(56) References Cited

U.S. PATENT DOCUMENTS 7,568,327 B2 * 8/2009 Lancaster, III ..... B65B 11/025 53/210
2005/0050861 A1 3/2005 Suolahti
(Continued)

FOREIGN PATENT DOCUMENTS

GB 2463008 A 3/2010

OTHER PUBLICATIONS

Patent Cooperation Treaty; International Search Report and Written Opinion; issued IN PCT application No. PCT/US2022/053035; 15 pages; dated Mar. 29, 2023.
(Continued)

*Primary Examiner* — Chinyere J Rushing-Tucker
(74) *Attorney, Agent, or Firm* — Gray Ice Higdon

(57) ABSTRACT

An apparatus for wrapping a load, comprising: a self-balancing paper-based packaging material dispenser configured to dispense paper-based packaging material to the load, the self-balancing paper-based packaging material dispenser including an exit point configured to tilt to compensate for a force imbalance between opposing edges of a web of the paper-based packaging material extending between the load and the exit point of the self-balancing paper-based packaging material dispenser; and a rotational drive configured to generate relative rotation between the self-balancing paper-based packaging material dispenser and the load about an axis of rotation.

25 Claims, 5 Drawing Sheets

(56) References Cited

U.S. PATENT DOCUMENTS

| | | | | |
|---|---|---|---|---|
| 2012/0124944 | A1 | 5/2012 | Lancaster, III et al. | |
| 2014/0123605 | A1 | 5/2014 | Cere'et al. | |
| 2020/0283176 | A1 | 9/2020 | Lancaster, III et al. | |
| 2025/0026512 | A1* | 1/2025 | Schwaiger | B65B 41/16 |

OTHER PUBLICATIONS

European Patent Office; Communication in Application No. 20 172 318.6 dated Jul. 30, 2024.

E80Group, posted 2025 [online], [retrieved Jul. 15, 2025]. Retrieved from internet, https://www.e80group.com/en/products/stretch-wrapping-systems-b-silkworm-b/silkworm-ecoturbo/.

* cited by examiner

LOAD WRAPPING APPARATUS AND METHOD WITH SELF-BALANCING PAPER-BASED PACKAGING MATERIAL DISPENSER

FIELD OF THE INVENTION

The invention generally relates to wrapping loads with paper-based packaging material through relative rotation of loads and a paper-based packaging material dispenser.

BACKGROUND OF THE INVENTION

Various packaging techniques have been used to build a load of unit products and subsequently wrap them for transportation, storage, containment and stabilization, protection and waterproofing. One system uses wrapping machines to stretch, dispense, and wrap a polymer-based packaging material, e.g., film, around a load. The polymer-based packaging material may also be pre-stretched before it is applied to the load. Wrapping can be performed as an inline, automated packaging technique that dispenses and wraps packaging material in a stretch condition around a load on a pallet to cover and contain the load. Stretch wrapping, whether accomplished by a turntable, rotating arm, vertical rotating ring, or horizontal rotating ring, typically covers the four vertical sides of the load with a stretchable packaging material such as polyethylene packaging material. In each of these arrangements, relative rotation is provided between the load and the packaging material dispenser to wrap packaging material about the sides of the load.

Worldwide sensitivity to sustainability has increased interest in non-polymer alternatives for wrapping loads. Initial candidates include relatively standard kraft paper to various alternatives that attempt to include some level of stretchability to accommodate the irregularity of virtually all wrapped loads and their fit to a pallet. Irrespective of the stretchability of such non-polymer alternatives, however, the degree of stretchability is generally less than that provided by polymer films.

Wrapping a load with materials exhibiting limited stretchability, however, presents several unique concerns relative to polymer films. Spiral wrapping, where a packaging material web is moved in a direction parallel to the axis of rotation concurrently with rotating around the axis of rotation, can cause non-stretchable packaging materials such as paper-based packaging materials to exhibit undesirable characteristics. The relative movement of a packaging material web relative to rotation is generally referred to as pitch, and is defined specifically as the relative web travel along the axis of rotation per load revolution. It has been observed that any change in pitch during a wrapping process will generally create an imbalance on the forces exhibited on the opposing edges of the web of packaging material, and cause puckering on one edge of the web as it is wrapped around the load. In addition, where the girth of a load changes at different elevations, force imbalances may also occur and cause similar undesirable effects.

A need therefore exists in the art for a manner of accommodating force imbalances in paper-based packaging material webs and other packaging material webs having limited stretchability.

SUMMARY OF THE INVENTION

The invention addresses these and other problems associated with the art by providing an apparatus for wrapping a load and method for operating the same that utilize a self-balancing paper-based packaging material dispenser to equalize forces on opposing edges of a web of paper-based packaging material extending between the packaging material dispenser and the load.

Therefore, consistent with one aspect of the invention, an apparatus for wrapping a load may include a self-balancing paper-based packaging material dispenser configured to dispense paper-based packaging material to the load, the self-balancing paper-based packaging material dispenser including an exit point configured to tilt to compensate for a force imbalance between opposing edges of a web of the paper-based packaging material extending between the load and the exit point of the self-balancing paper-based packaging material dispenser, and a rotational drive configured to generate relative rotation between the self-balancing paper-based packaging material dispenser and the load about an axis of rotation.

In some embodiments, the exit point includes an exit idle roller. Further, in some embodiments, the self-balancing paper-based packaging material dispenser includes a support structure configured to support a roll of paper-based packaging material, and the support structure is pivotably supported to pivot about a pivot axis that is substantially perpendicular to the axis of rotation. In some embodiments, the support structure further supports a plurality of rollers defining a serpentine path through which paper-based packaging material is dispensed from the roll of paper-based packaging material.

Further, in some embodiments, the support structure is pivotably supported by a low friction support bearing and the pivot axis is positioned proximate a center of gravity of the self-balancing paper-based packaging material dispenser. Also, in some embodiments, the support structure is freely pivotable about the pivot axis such that a force imbalance between the opposing edges of the web naturally tilts the support structure to equalize forces exerted on the opposing edges of the web.

In addition, some embodiments may also include a rotary actuator configured to controllably rotate the support structure about the pivot axis, at least one sensor configured to sense force exerted on the web of paper-based packaging material, and a control circuit coupled to the rotary actuator and the at least one sensor and configured to drive the rotary actuator in response to the sensed force to controllably rotate the support structure to equalize forces exerted on the opposing edges of the web. In some embodiments, the at least one sensor includes a first sensor configured to sense a force exerted on a first edge of the web of paper-based packaging material dispenser, and a second sensor configured to sense a force exerted on a second edge of the web of paper-based packaging material dispenser. In addition, in some embodiments, the exit point includes an exit idle roller, and the first and second sensors are load cells coupled to first and second ends of the idle roller.

Also, in some embodiments, the self-balancing paper-based packaging material dispenser includes a support structure configured to support a roll of paper-based packaging material, and the exit point is movable relative to the support structure to compensate for the force imbalance between the opposing edges of the web. In addition, in some embodiments, the exit point includes an exit idle roller. In some embodiments, the exit idle roller is pivotably mounted to the support structure to pivot about a roller pivot axis that is substantially perpendicular to an axis of rotation of the roller. Further, in some embodiments, at least one end of the exit idle roller is coupled to the support structure through a floating coupling. In addition, in some embodiments, the exit idle roller includes an axle and the floating coupling includes a support including a slot through which an end of the axle projects, and a bias mechanism coupled between the support and the end of the axle. Further, in some embodiments, both ends of the exit idle roller are coupled to the support structure through floating couplings.

Some embodiments may further include a lift drive configured to move the self-balancing paper-based packaging material dispenser in a direction generally parallel to the axis of rotation. Further, in some embodiments, tilting of the exit point to compensate for the force imbalance between the opposing edges of the web reduces puckering of at least one edge of the web when the lift drive is moving the self-balancing paper-based packaging material dispenser while the rotational drive is generating relative rotation between the self-balancing paper-based packaging material dispenser and the load. In some embodiments, tilting of the exit point to compensate for the force imbalance between the opposing edges of the web reduces puckering of an edge of the web proximate a portion of a load having different girths at different elevations when the lift drive is moving the self-balancing paper-based packaging material dispenser while the rotational drive is generating relative rotation between the self-balancing paper-based packaging material dispenser and the load.

Some embodiments may also include a cutting mechanism positioned to form one or more longitudinal slits in the web of paper-based packaging material to reduce the force imbalance between the opposing edges of the web. Moreover, in some embodiments, the cutting mechanism is configured to continuously form the one or more longitudinal slits during relative rotation between the load and the self-balancing paper-based packaging material dispenser. Further, in some embodiments, the cutting mechanism is configured to selectively form the one or more longitudinal slits during relative rotation between the load and the self-balancing paper-based packaging material dispenser. In addition, in some embodiments, the cutting mechanism is configured to selectively form the one or more longitudinal slits when the self-balancing paper-based packaging material dispenser is moving in a direction generally parallel to the axis of rotation. Also, in some embodiments, the cutting mechanism is configured to selectively form the one or more longitudinal slits when the self-balancing paper-based packaging material dispenser for portions of the web that are proximate corners of the load.

Consistent with another aspect of the invention, an apparatus for wrapping a load may include a self-balancing paper-based packaging material dispenser configured to dispense paper-based packaging material to the load, the self-balancing paper-based packaging material dispenser including a support structure configured to support a roll of paper-based packaging material and a plurality of rollers defining a serpentine path through which paper-based packaging material is dispensed from the roll of paper-based packaging material to the load, and a low friction support bearing pivotably supporting the support structure to enable the support structure to freely pivot about a pivot axis that is substantially perpendicular to an axis of rotation for wrapping such that a force imbalance between opposing edges of a web of paper-based packaging material extending from an exit point of the self-balancing paper-based packaging material dispenser to the load naturally tilts the support structure to equalize forces exerted on the opposing edges of the web. The apparatus may also include a rotational drive configured to generate relative rotation between the self-balancing paper-based packaging material dispenser and the load about the axis of rotation.

Consistent with another aspect of the invention, an apparatus for wrapping a load may include a self-balancing paper-based packaging material dispenser configured to dispense paper-based packaging material to the load, the self-balancing paper-based packaging material dispenser including a support structure configured to support a roll of paper-based packaging material and a plurality of rollers defining a serpentine path through which paper-based packaging material is dispensed from the roll of paper-based packaging material to the load, and a low friction support bearing pivotably supporting an exit point of the self-balancing paper-based packaging material dispenser on the support structure to enable the exit point to freely pivot about a pivot axis that is substantially perpendicular to an axis of rotation for wrapping such that a force imbalance between opposing edges of a web of paper-based packaging material extending from the exit point to the load naturally tilts the exit point to equalize forces exerted on the opposing edges of the web. The apparatus may further include a rotational drive configured to generate relative rotation between the self-balancing paper-based packaging material dispenser and the load about the axis of rotation.

Consistent with another aspect of the invention, an apparatus for wrapping a load may include a self-balancing paper-based packaging material dispenser configured to dispense paper-based packaging material to the load, the self-balancing paper-based packaging material dispenser including a support structure configured to support a roll of paper-based packaging material and a plurality of rollers defining a serpentine path through which paper-based packaging material is dispensed from the roll of paper-based packaging material to the load, and an exit point of the self-balancing paper-based packaging material dispenser coupled to the support structure through at least one floating coupling to enable the exit point to float such that a force imbalance between opposing edges of a web of paper-based packaging material extending from the exit point to the load allows the exit point to tilt to equalize forces exerted on the opposing edges of the web. The apparatus may also include a rotational drive configured to generate relative rotation between the self-balancing paper-based packaging material dispenser and the load about an axis of rotation.

Consistent with another aspect of the invention, an apparatus for wrapping a load may include a self-balancing paper-based packaging material dispenser configured to dispense paper-based packaging material to the load, the self-balancing paper-based packaging material dispenser including a support structure configured to support a roll of paper-based packaging material and a plurality of rollers defining a serpentine path through which paper-based packaging material is dispensed from the roll of paper-based packaging material to the load, a rotary actuator configured to controllably rotate the support structure about a pivot axis that is substantially perpendicular to an axis of rotation for wrapping, and at least one sensor configured to sense force exerted on a web of paper-based packaging material extending from an exit point of the self-balancing paper-based packaging material dispenser to the load. The apparatus may further include a rotational drive configured to generate relative rotation between the self-balancing paper-based packaging material dispenser and the load about the axis of rotation, and a control circuit coupled to the rotary actuator and the at least one sensor and configured to drive the rotary actuator in response to the sensed force to controllably rotate the support structure to equalize forces exerted on opposing edges of the web.

Consistent with another aspect of the invention, an apparatus for wrapping a load may include a paper-based packaging material dispenser configured to dispense paper-based packaging material to the load, a rotational drive configured to generate relative rotation between the self-balancing paper-based packaging material dispenser and the load about an axis of rotation, and a cutting mechanism configured to form one or more longitudinal slits in a web of paper-based packaging material extending between an exit point of the paper-based packaging material dispenser and the load to reduce the force imbalance between the opposing edges of the web.

Consistent with another aspect of the invention, an apparatus for wrapping a load may include a self-balancing packaging material dispenser configured to dispense packaging material to the load, the self-balancing packaging material dispenser including an exit point configured to tilt to compensate for a force imbalance between opposing edges of a web of the packaging material extending between the load and the exit point of the self-balancing packaging material dispenser, and a rotational drive configured to generate relative rotation between the self-balancing packaging material dispenser and the load about an axis of rotation.

Other embodiments may include a method of operating any of the load wrapping apparatus discussed above.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention.

DETAILED DESCRIPTION

Embodiments consistent with the invention may incorporate a self-balancing paper-based packaging material dispenser to compensate for force imbalances across a web of paper-based packaging material during wrapping and thereby optimize wrapping of a load with a paper-based packaging material. Various mechanical and electromechanical mechanisms, disclosed in greater detail below, may be used to compensate for imbalanced forces exerted upon the opposing edges of a web of paper-based packaging material extending between a load and a paper-based packaging material dispenser during wrapping.

A paper-based packaging material, in this regard, may be considered to include materials formed fully or partially from cellulous fibers and/or other fibers exhibiting similar characteristics, most notably a reduced stretchability and/or elasticity compared to polymer film-based packaging materials that have traditionally been used to wrap palletized loads. In some embodiments, a paper-based packaging material may include various materials that are substantially formed from wood fiber, and in some embodiments, a paper-based packaging material may include various materials that are substantially not plastically deformable, in contrast with many polymer films. Also, in some embodiments, paper-based packaging material may include various types of non-plastic, non-stretchable and/or non-elastic materials. Some non-limiting examples of paper-based packaging materials include kraft paper, coated paper, etc. It will also be appreciated, however, that the principles of the invention may also be useful for wrapping with polymer films and other plastic, stretchable or elastic materials in some embodiments.

Prior to a further discussion of self-balancing paper-based packaging material dispensers, however, a brief discussion of various types of wrapping apparatus within which the various techniques disclosed herein may be implemented is provided.

Wrapping Apparatus Configurations

Figure 1:
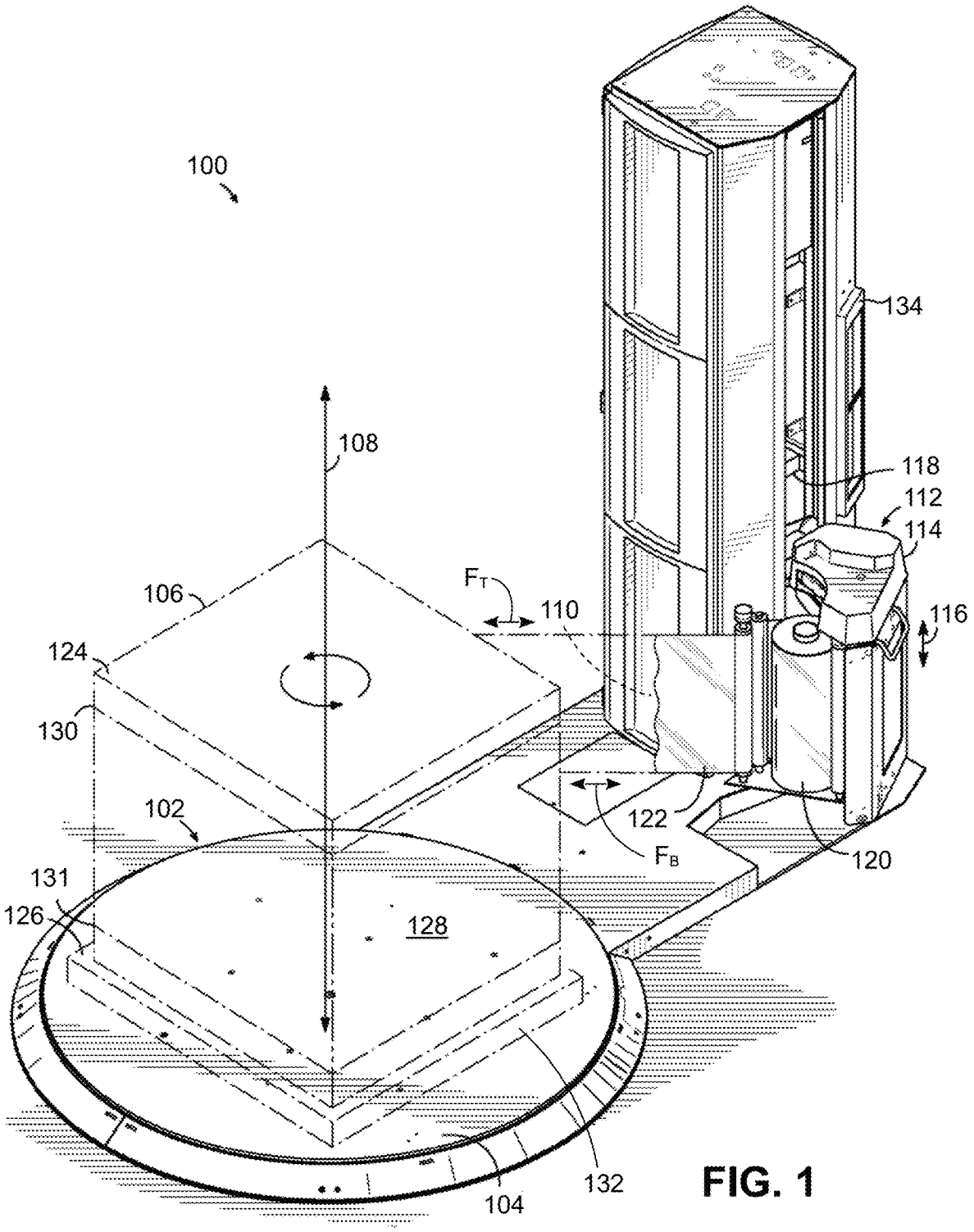
FIG. 1 shows a perspective view of a turntable-type wrapping apparatus consistent with the invention.

Various wrapping apparatus configurations may be used in various embodiments of the invention. For example, FIG. 1 illustrates a turntable-type wrapping apparatus 100 including a load support 102 configured as a rotating turntable 104 for supporting a load 106. Turntable 104 rotates about an axis of rotation 108, e.g., in a counter-clockwise direction as shown in FIG. 1, using a rotational drive 110 including, for example, an electric motor. It will be appreciated that the principles of the invention may be applicable to other types of wrapping apparatus configurations, e.g., rotating arm-type and ring-type configurations, so the invention is not limited to a turntable-type wrapping apparatus.

A paper-based packaging material dispenser 112, including a roll carriage 114, is configured for movement along a direction 116 by a lift drive 118 which may, for example, include an electric motor. Roll carriage 114 supports a roll 120 of paper-based packaging material, which during a wrapping operation includes a web 122 extending between packaging material dispenser 112 and load 106, with the packaging material moving in a generally downstream direction towards the load. The terms "upstream" and "downstream," as used in this application, are intended to define positions and movement relative to the direction of flow of packaging material as it moves from packaging material dispenser 112 to load 106. Movement of an object toward packaging material dispenser 112, away from load 106, and thus, against the direction of flow of packaging material, may be defined as "upstream." Similarly, movement of an object away from packaging material dispenser 112, toward load 106, and thus, with the flow of the packaging material, may be defined as "downstream."

Direction 116 is generally parallel to an axis about which packaging material is wrapped around load 106, e.g., axis 108, and movement of roll carriage 114, and thus web 122, along direction 116 during a wrapping operation enables packaging material to be wrapped spirally around the load, e.g., within a contiguous region between a top 124 and bottom 126 of load 106, e.g., region 128 between positions 130, 131 as illustrated in FIG. 1. In some instances, the load 106 may also be considered to include a pallet 132 upon which the load is disposed, so the contiguous region may therefore optionally include at least a portion of the pallet in some embodiments.

Control of the position of roll carriage 114 by lift drive 118, as well as of the other drives in wrapping apparatus 100 such as rotational drive 110, is provided by a controller 134, which in the embodiment illustrated in FIG. 1 is a local controller that is physically co-located with rotational drive 110 and lift drive 118. Controller 134 may include hardware components and/or software program code that allow it to receive, process, and transmit data. It is contemplated that controller 134 may be implemented as a programmable logic controller (PLC), or may otherwise operate similar to a processor in a computer system. Controller 134 may communicate with an operator interface, e.g., a display or screen and controls that provide an operator with a way to monitor, program, and operate wrapping apparatus 100. Controller 134 may also communicate with one or more sensors to allow controller 134 to receive feedback and/or performance-related data during wrapping, such as roller and/or drive rotation speeds, load dimensional data, etc.

For the purposes of the invention, controller 134 may represent practically any type of computer, computer system, controller, logic controller, or other programmable electronic device, and may in some embodiments be implemented using one or more networked computers or other electronic devices, whether located locally or remotely with respect to the various drives 110, 118 of wrapping apparatus 100. Controller 134 typically includes a central processing unit including at least one microprocessor coupled to a memory, which may represent the random access memory (RAM) devices comprising the main storage of controller 134, as well as any supplemental levels of memory, e.g., cache memories, non-volatile or backup memories (e.g., programmable or flash memories), read-only memories, etc. In addition, the memory may be considered to include memory storage physically located elsewhere in controller 134, e.g., any cache memory in a processor, as well as any storage capacity used as a virtual memory, e.g., as stored on a mass storage device or on another computer or electronic device coupled to controller 134. Controller 134 may also include one or more mass storage devices, e.g., a floppy or other removable disk drive, a hard disk drive, a direct access storage device (DASD), an optical drive (e.g., a CD drive, a DVD drive, etc.), and/or a tape drive, among others. Furthermore, controller 134 may include an interface with one or more networks (e.g., a LAN, a WAN, a wireless network, and/or the Internet, among others) to permit the communication of information to the components in wrapping apparatus 100 as well as with other computers and electronic devices, e.g. computers such as a desktop computer or laptop computer, mobile devices such as a mobile phone or tablet, multi-user computers such as servers or cloud resources, etc. Controller 134 operates under the control of an operating system, kernel and/or firmware and executes or otherwise relies upon various computer software applications, components, programs, objects, modules, data structures, etc. Moreover, various applications, components, programs, objects, modules, etc. may also execute on one or more processors in another computer coupled to controller 134, e.g., in a distributed or client-server computing environment, whereby the processing required to implement the functions of a computer program may be allocated to multiple computers over a network.

In general, the routines executed to implement the embodiments of the invention, whether implemented as part of an operating system or a specific application, component, program, object, module or sequence of instructions, or even a subset thereof, will be referred to herein as "computer program code," or simply "program code." Program code typically comprises one or more instructions that are resident at various times in various memory and storage devices in a computer, and that, when read and executed by one or more processors in a computer, cause that computer to perform the steps necessary to execute steps or elements embodying the various aspects of the invention. Moreover, while the invention has and hereinafter will be described in the context of fully functioning controllers, computers and computer systems, those skilled in the art will appreciate that the various embodiments of the invention are capable of being distributed as a program product in a variety of forms, and that the invention applies equally regardless of the particular type of computer readable media used to actually carry out the distribution.

Such computer readable media may include computer readable storage media and communication media. Computer readable storage media is non-transitory in nature, and may include volatile and non-volatile, and removable and non-removable media implemented in any method or technology for storage of information, such as computer-readable instructions, data structures, program modules or other data. Computer readable storage media may further include RAM, ROM, erasable programmable read-only memory (EPROM), electrically erasable programmable read-only memory (EEPROM), flash memory or other solid state memory technology, CD-ROM, digital versatile disks (DVD), or other optical storage, magnetic cassettes, magnetic tape, magnetic disk storage or other magnetic storage devices, or any other medium that can be used to store the desired information and which can be accessed by controller 134. Communication media may embody computer readable instructions, data structures or other program modules. By way of example, and not limitation, communication media may include wired media such as a wired network or direct-wired connection, and wireless media such as acoustic, RF, infrared and other wireless media. Combinations of any of the above may also be included within the scope of computer readable media.

Various program code described hereinafter may be identified based upon the application within which it is implemented in a specific embodiment of the invention. However, it should be appreciated that any particular program nomenclature that follows is used merely for convenience, and thus the invention should not be limited to use solely in any specific application identified and/or implied by such nomenclature. Furthermore, given the typically endless number of manners in which computer programs may be organized into routines, procedures, methods, modules, objects, and the like, as well as the various manners in which program functionality may be allocated among various software layers that are resident within a typical computer (e.g., operating systems, libraries, API's, applications, applets, etc.), it should be appreciated that the invention is not limited to the specific organization and allocation of program functionality described herein.

In the discussion hereinafter, the hardware and software used to control wrapping apparatus 100 is assumed to be incorporated wholly within components that are local to wrapping apparatus 100 illustrated in FIG. 1. It will be appreciated, however, that in other embodiments, at least a portion of the functionality incorporated into a wrapping apparatus may be implemented in hardware and/or software that is external to the aforementioned components. For example, in some embodiments, some user interaction may be performed using an external device such as a networked computer or mobile device, with the external device converting user or other input into control variables that are used to control a wrapping operation. In other embodiments, user interaction may be implemented using a web-type interface, and the conversion of user input may be performed by a server or a local controller for the wrapping apparatus, and thus external to a networked computer or mobile device. In still other embodiments, a central server may be coupled to multiple wrapping stations to control the wrapping of loads at the different stations. As such, the operations of receiving user or other input, converting the input into control variables for controlling a wrap operation, initiating and implementing a wrap operation based upon the control variables, providing feedback to a user, etc., may be implemented by various local and/or remote components and combinations thereof in different embodiments. In some embodiments, for example, an external device such as a mobile device, a networked computer, a server, a cloud service, etc. may generate a wrap model that defines the control variables for controlling a wrap operation for a particular load, and that wrap model may then be communicated to a wrapping apparatus and used by a controller therefor to control a dispense rate during a wrap operation. As such, the invention is not limited to the particular allocation of functionality described herein.

Load Wrapping Apparatus with Self-Balancing Paper-Based Packaging Material Dispenser As noted above, worldwide sensitivity to sustainability has increased interest in non-polymer alternatives such as kraft paper for wrapping loads, all of which tend to have reduced stretchability compared to polymer films. Wrapping a load with materials exhibiting limited stretchability, however, presents several unique concerns relative to polymer films. Spiral wrapping, where a packaging material web is moved in a direction parallel to the axis of rotation concurrently with rotating around the axis of rotation, can cause non-stretchable packaging materials such as paper-based packaging materials to exhibit undesirable characteristics such as puckering along one edge of the packaging material. Changes in pitch during a wrapping process have been found to create an imbalance on the forces exhibited on the opposing edges of the web of packaging material, and cause puckering on one edge of the web as it is wrapped around the load. In addition, where the girth of a load changes at different elevations, i.e., where the girth of the load proximate one edge of the packaging material web differs appreciably from that proximate to the other edge of the packaging material web, force imbalances may also occur and cause similar undesirable effects.

FIG. 1, for example, represents the forces exerted on the opposing edges (top and bottom in the case of a vertical axis of rotation) of paper-based packaging material web 122 at $F_T$ and $F_B$. When these forces $F_T$ and $F_B$ are not substantially equal to one another, a possibility for generating undesirable wrapping characteristics exists.

In particular, when the forces exerted on the opposing edges of a paper-based packaging material web are unbalanced, puckering has been found to occur on an edge of the web when the packaging material dispenser is moving in a direction parallel to the axis of rotation during wrapping. Likewise, puckering tends to occur in response to a change of girth in a load as packaging material is wrapped around the load while the packaging material dispenser is moving parallel to the axis of rotation.

Embodiments consistent with the invention, on the other hand, address these force imbalances by utilizing a self-balancing paper-based packaging material dispenser to compensate for the force imbalances and optimize wrapping with a paper-based packaging material. In various embodiments, an exit point of a packaging material dispenser, typically an exit roller, may be selectively inclined so that the forces exerted upon the opposing edges of the paper-based packaging material web may be substantially balanced, and this inclination in different embodiments may include only the component utilized as the exit point, or may include additional components in the packaging material dispenser in some embodiments, or even the entire packaging material dispenser in some embodiments.

Various mechanical or electromechanical approaches may be used in different embodiments to self-balance a paper-based packaging material dispenser through selective inclination of an exit point of a packaging material dispenser. In the embodiments discussed below, the exit point of a packaging material dispenser is implemented using an exit idle roller that is the last roller that the packaging material web contacts before exiting the packaging material dispenser and proceeding to the load, and is thus, the structure in the packaging material dispenser that defines one end of the packaging material web that extends between the load and the packaging material dispenser. It will be appreciated, however, that in other embodiments, the exit point may be implemented by other structures, e.g., a driven roller or a non-rotating bar or other surface.

In one example embodiment, the packaging material dispenser itself may be mounted on a low friction support bearing structure for rotation about a pivot axis that is substantially perpendicular to the axis of rotation used when wrapping (e.g., a generally horizontal axis in the case of a vertical axis of rotation for wrapping). In addition, the pivot axis of the packaging material dispenser may be selected to be positioned proximate a center of gravity of the packaging material dispenser (e.g., such that the mass of the packaging material dispenser above the pivot axis substantially equals that below the pivot axis), such that minimal torque is applied to the packaging material dispenser by gravity and any imbalance in forces exerted on the top and bottom edges of the packaging material web will naturally tilt the packaging material dispenser to tilt the exit idle roller and thereby substantially equalize the forces exerted on the top and bottom edges of the packaging material web.

In another example embodiment, a floating exit point, e.g., a floating exit idle roller, may be used to enable the floating exit point to substantially equalize the forces exerted on the top and bottom edges of the packaging material web. In some instances, for example, one or both ends of an exit idle roller may be movable to alter the inclination of the roller. In one example embodiment, an exit idle roller may be mounted to a packaging material dispenser to additionally rotate about a roller pivot axis that is generally perpendicular to the exit idle roller's axis of rotation such that the exit idle roller naturally tilts to substantially equalize the forces exerted on the top and bottom edges of the packaging material web. In another example embodiment, one or both ends of an exit idle roller may be movable in a linear direction that is generally perpendicular to the axis of rotation of the roller, and biased by a spring or other bias mechanism such that the end(s) of the exit idle roller move varying degrees along the linear direction based upon the force exerted by the proximate edge(s) of the packaging material web during wrapping.

In yet another example embodiment, an electromechanical approach may be used where, instead of allowing for free rotation or motion of a packaging material dispenser and/or an exit point thereof, one or more sensors may be used to sense the force imbalance between the opposing edges of the packaging material web, and the packaging material dispenser and/or the exit point thereof may be controllably rotated or moved to compensate for the sensed force imbalance.

It will also be appreciated that one or more of the above approaches may be combined in some embodiments, e.g., by applying different compensation mechanisms to the exit point and the packaging material dispenser itself. It will also be appreciated that in some instances the various approaches all effectively incline or tilt the exit point in a dynamic fashion, and generally in response to the forces exerted on the opposing edges of the web of paper-based packaging material. This is in contrast to controlling the inclination or tilt of an exit point of a packaging material in a predetermined fashion and/or in a manner that is not responsive to the forces exerted on the opposing edges of the web of paper-based packaging material.

In addition, in addition to or in lieu of the above approaches, some embodiments may form one or more longitudinal slits in a paper-based packaging material to effectively reduce the width of the packaging material web and thereby reduce overall force imbalances between the opposing edges of the overall packaging material web. As will become more apparent below, one or more longitudinal slits may be formed continuously during wrapping in some embodiments, or may be formed selectively in other embodiments, e.g., only when the packaging material dispenser is moving along the axis of rotation and/or only for portions of the packaging material web that are proximate the corners of the load.

Now turning to FIGS. 2-5, these figures illustrate a self-balancing paper-based packing material dispenser 150 consistent with some embodiments of the invention, and in which packaging material dispenser 150 is configured to rotate relative to a wrapping apparatus frame 152 about a pivot axis P. Pivot axis P is selected to substantially at a center of gravity for packaging material dispenser 150, e.g., with the mass of the packaging material dispenser above the dispenser rotational axis substantially equaling that below the dispenser rotational axis such that minimal torque is applied to the packaging material dispenser by gravity. A support structure 154 of packaging material dispenser 150 supports a packaging material roll support 156 and a drive roller 158, with a pair of idle rollers 160, 162 disposed upstream and downstream of drive roller 158, respectively, such that packaging material 164 from a packaging material roll 166 disposed on roll support 156 (FIGS. 4-5) extends in a serpentine fashion around idle roller 160, drive roller 158 and idle roller 162, with idle roller 162 forming the exit point for packaging material dispenser 150. As such, pivot axis P, as well as the overall design of packaging material dispenser 150, are desirably configured to substantially balance the packaging material dispenser irrespective of how much packaging material is left on packaging material roll 166 and thereby minimize torque about pivot axis P due to gravity.

Figure 3:
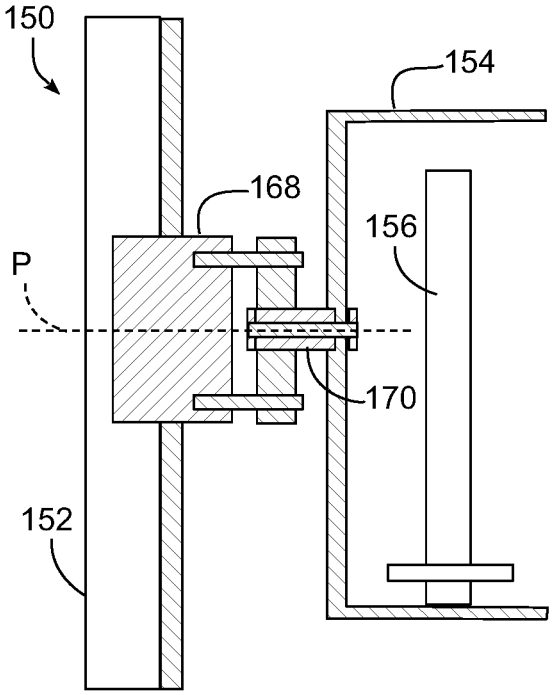
FIG. 3 is a cross-sectional view taken through lines 3-3 of FIG. 2.

While a number of different structures may be used in other embodiments, in the illustrated embodiment, support structure 154 of packaging material dispenser 150 is mounted to a dispenser support 168 through a low friction support bearing 170 (FIG. 3). Dispenser support 168 is movable vertically along frame 152 to control the elevation of packaging material dispenser 150, but due to support bearing 170, the packaging material dispenser is freely allowed to pivot or tilt about pivot axis P.

Figure 4:
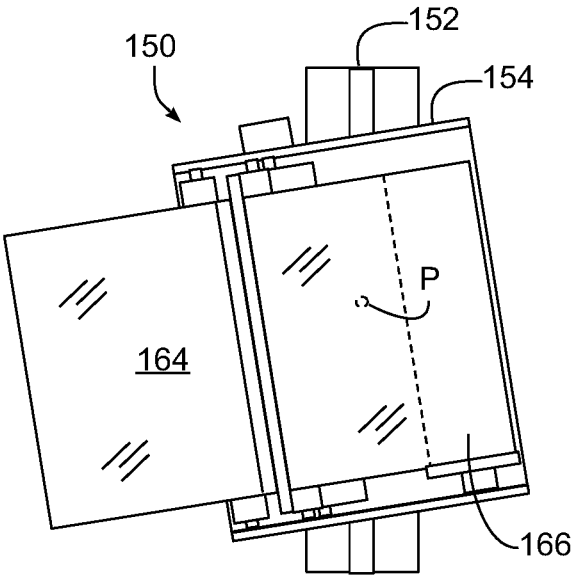
FIG. 4 is a side elevational view of the self-balancing paper-based packaging material dispenser of FIG. 2, with counter-clockwise pivoting imparted thereto.
Figure 5:
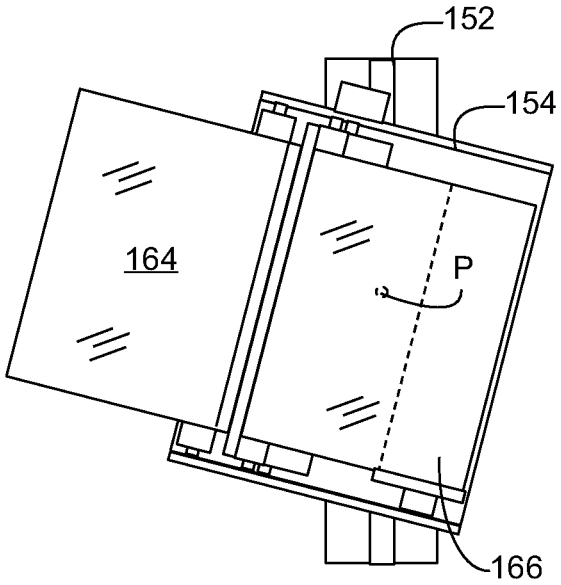
FIG. 5 is a side elevational view of the self-balancing paper-based packaging material dispenser of FIG. 2, with clockwise pivoting imparted thereto.

As such, and as illustrated in FIGS. 4 and 5, due at least in part to the substantially balanced nature of packaging material dispenser 150, any imbalance in forces exerted on the top and bottom edges of the packaging material web 164 will naturally tilt the packaging material dispenser counterclockwise (FIG. 4) or clockwise (FIG. 5) about pivot axis P to tilt the exit point (idle roller 162) and thereby substantially equalize the forces exerted on the top and bottom edges of packaging material web 164.

Figure 2:
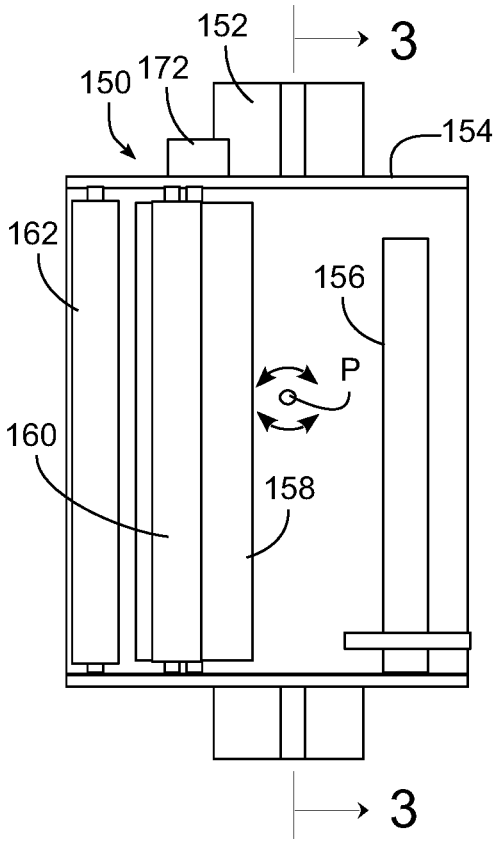
FIG. 2 is a side elevational view of an example implementation of a self-balancing paper-based packaging material dispenser capable of being used in the wrapping apparatus of FIG. 1, and including a freely pivotable support structure.

It will be appreciated that self-balancing paper-based packaging material dispenser 150 may be driven or undriven in different embodiments. As illustrated in FIG. 2, in some embodiments, a brake or drive 172 may be used to control rotation of drive roller 158 and thus the dispense rate of paper-based packaging material from the packaging material dispenser, which in combination with the relative rotation between the load and packaging material dispenser, also controls the tension in the web of paper-based packaging material. In some embodiments, a fixed dispense rate may be used, while in other embodiments the brake or drive 172 may be electronically controlled to vary the dispense rate and thus the tension in the web. In some embodiments, for example, an electronic disc brake may be used to control the rotation of drive roller 158 and thereby control tension in the web.

In addition, in some embodiments, a packaging material dispenser may include multiple drive rollers, e.g., in the case of packaging material dispensers designed for prestretching when used to dispense polymer-based packaging material. In such instances, it may be desirable to configure the packaging material dispenser (e.g., by selecting appropriate prestretch pulleys or gears), or otherwise control the packaging material dispenser, to drive the multiple drive rollers at a 1:1 ratio so that no prestretching is performed when used with paper-based packaging materials. By doing so, a packaging material dispenser designed for polymer-based packaging materials may be retrofitted for use with a paper-based packaging material with relatively minor modifications. It may also be desirable in some embodiments to drive the drive rollers using a variable frequency drive torque control such as is described in U.S. Publication No. 2020/0122866A1, which is assigned to the same assignee as the present application, and is incorporated by reference herein.

Figure 6:
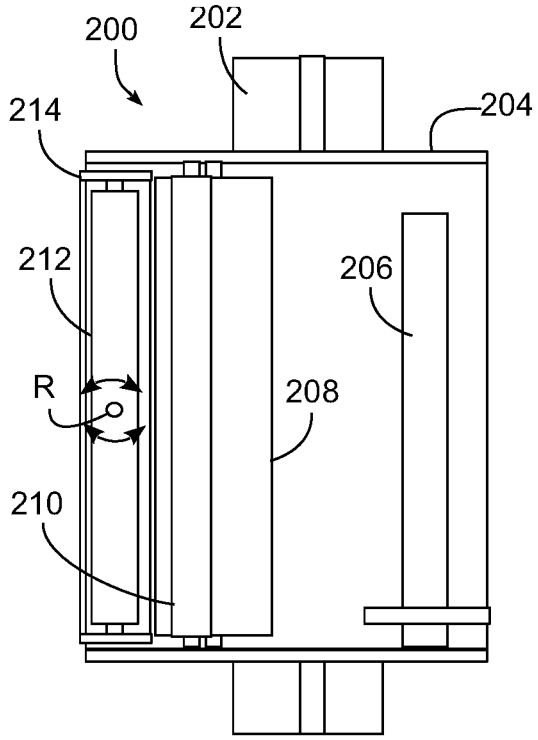
FIG. 6 is a side elevational view of another example implementation of a self-balancing paper-based packaging material dispenser capable of being used in the wrapping apparatus of FIG. 1, and including a freely pivotable exit idle roller.
Figure 7:
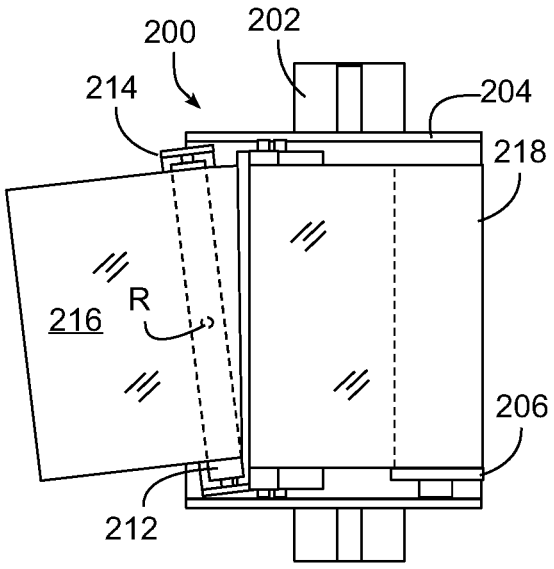
FIG. 7 is a side elevational view of the self-balancing paper-based packaging material dispenser of FIG. 6, with counter-clockwise pivoting imparted to the exit idle roller thereof.
Figure 8:
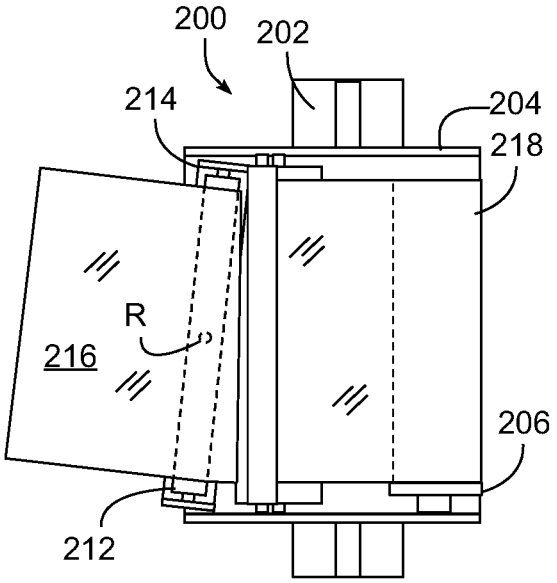
FIG. 8 is a side elevational view of the self-balancing paper-based packaging material dispenser of FIG. 6, with clockwise pivoting imparted to the exit idle roller thereof.

Next, as illustrated by self-balancing paper-based packaging material dispenser 200 in FIG. 6-8, rather than tilting or pivoting the entire packaging material dispenser, only a portion of the packaging material dispenser, here an exit idle roller, may be pivoted to compensate for force imbalances across a paper-based packaging material web.

FIG. 6, in particular, illustrates a packaging material dispenser 200 mounted for vertical movement relative to a wrapping apparatus frame 202 and having a support structure 204 that is not rotatable relative to frame 202. Similar to packaging material dispenser 150 of FIGS. 2-5, packaging material dispenser 200 includes a roll support 206, drive roller 208 and idle rollers 210, 212, with idle roller 212 being an exit idle roller serving as the exit point for packaging material dispenser 200. Idle roller 212, however, is not mounted in a fixed position in support structure 204, but rather is mounted to a bracket 214 that is pivotable about a roller pivot axis R that is substantially perpendicular to the axis of rotation of roller 212, and that is desirably selected to be proximate a center of gravity of the idle roller 212 and bracket 214. A low friction support bearing (not shown in FIG. 6) may be used to support bracket 214 on support structure 204 and allow for free movement of bracket 214 about roller pivot axis R in some embodiments.

As such, and as illustrated in FIGS. 7 and 8, any imbalance in forces exerted on the top and bottom edges of a packaging material web 216 dispensed from a packaging material roll 218 supported by roll support 206 will naturally tilt bracket 214 counter-clockwise (FIG. 7) or clockwise (FIG. 8) about roller pivot axis R to tilt the exit point (idle roller 212) and thereby substantially equalize the forces exerted on the top and bottom edges of packaging material web 216.

Figure 9:
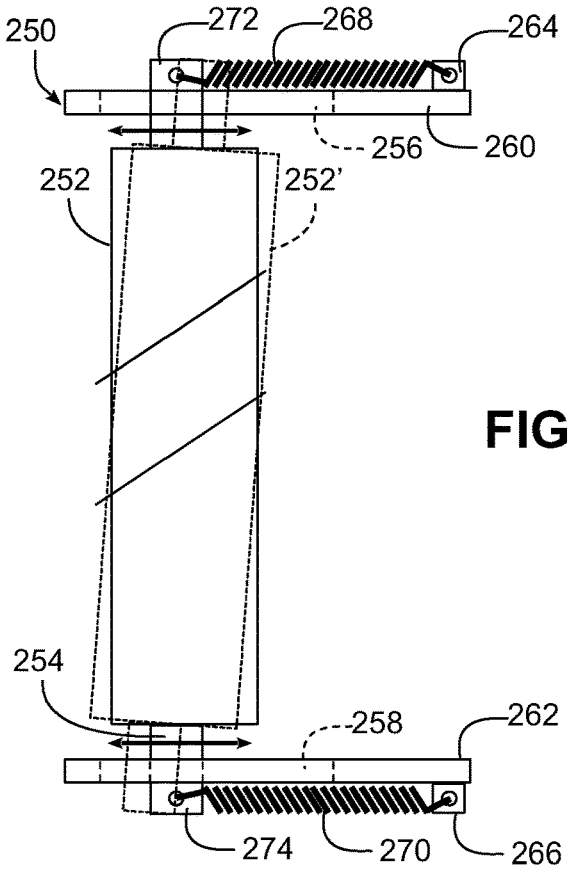
FIG. 9 is a side elevational view of another example implementation of a self-balancing paper-based packaging material dispenser capable of being used in the wrapping apparatus of FIG. 1, and including an exit idle roller with floating couplings.

Next turning to FIG. 9, this figure illustrates another self-balancing paper-based packaging material dispenser 250 that incorporates a "floating" exit point, here an exit idle roller 252 with an axle 254 that is mounted at one or both ends to a support structure of the packaging material dispenser through a floating coupling. In particular, axle 254 is slidably mounted in slots 256, 258 respectively disposed in supports 260, 262. Supports 260, 262 in some embodiments may be integrated into, or otherwise coupled, for example, to a support structure similar to support structure 204 of packaging material dispenser 200 of FIGS. 6-8, and as such, the other components of packaging material dispenser 250, e.g., a roll support, other drive and/or idle rollers, etc., are not shown in FIG. 9.

Each support 260, 262 includes a fixed mount 264, 266, and a bias mechanism 268, 270 (e.g., a spring) is coupled between each fixed mount 264, 266 and a corresponding mount 272, 274 disposed on an end of axle 254. Both ends of axle 254 are therefore allowed to slide within slots 256, 258 in response to forces exerted by the top and bottom edges of a web of paper-based packaging material extending between idle roller 252 and a load. As such, and as illustrated at 252', any imbalance in forces exerted on the top and bottom edges of a packaging material web will naturally tilt exit idle roller 252 to substantially equalize the forces exerted on the top and bottom edges of the packaging material web. Selection of springs 268, 270 as well as the length and position of each slot 256, 268 may be based upon the amount of bias needed to allow for sufficient travel of each end of exit idle roller 252 to equalize forces at the top and bottom edges of the packaging material web, as will be appreciated by those of ordinary skill having the benefit of the instant disclosure.

It will be appreciated that in other embodiments, only one end of an exit idle roller may float. It will also be appreciated that other mechanical arrangements may be used to allow for movement of an end of an exit idle roller. It will also be appreciated that it may also be desirable to use bias mechanisms in packaging material dispensers 150, 200 to resist pivoting about axes P and R in some embodiments.

Figure 10:
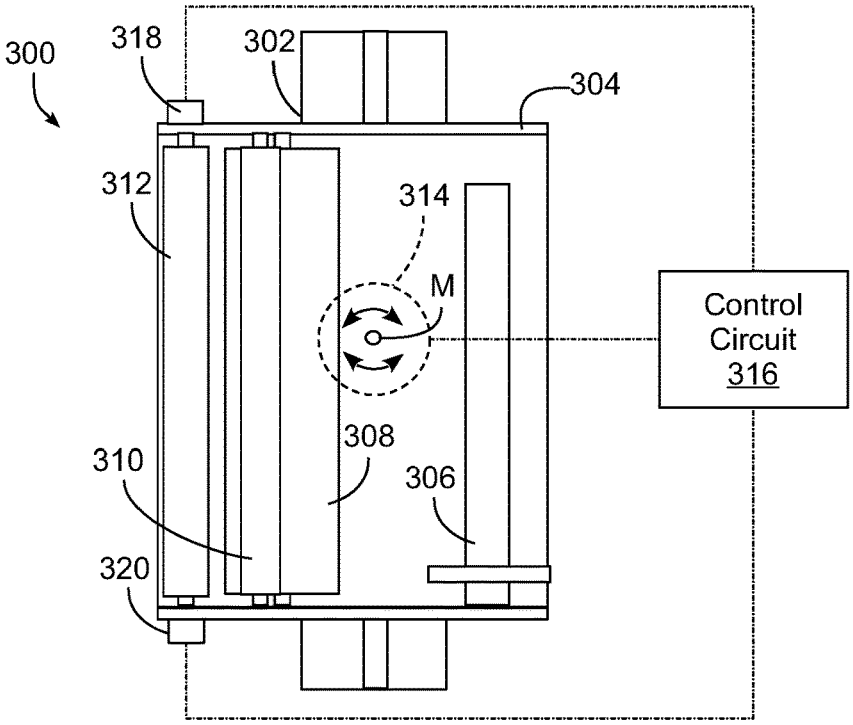
FIG. 10 is a side elevational view of another example implementation of a self-balancing paper-based packaging material dispenser capable of being used in the wrapping apparatus of FIG. 1, and including an electromechanically-driven rotatable support structure.

Now turning to FIG. 10, while the self-balancing paper-based packaging material dispensers described above are purely mechanical arrangements, in other embodiments it may be desirable to controllably tilt or move an exit point of a packaging material dispenser using an electromechanical arrangement. FIG. 10 in particular illustrates a self-balancing paper-based packaging material dispenser 300 that is movable vertically along a wrapping apparatus frame 302 and includes a support structure 304 that supports a roll support 306, drive roller 308 and idle rollers 310, 312. Similar to packaging material dispenser 150 of FIGS. 2-5, packaging material dispenser 300 is pivotable about a pivot axis, here pivot axis M, that is generally perpendicular to the axis of rotation for wrapping, such that the exit point of the packaging material dispenser, here exit idle roller 312, is tiltable to equalize forces at the top and bottom edges of a paper-based packaging material web.

Rather than being freely pivotable about axis M, however, packaging material dispenser 300 is mounted to a motor 314 or other rotary actuator that is capable of controlling the rotation of packaging material dispenser 300 about axis M, e.g., under the control of a control circuit 316, which in some embodiments may be implemented at least in part in the main controller of a wrapping apparatus, and in other embodiments may be separate therefrom.

One or more sensors, e.g., load cells 318, 320 disposed at opposite ends of idle roller 312, may be used to sense the forces exerted at one or both edges of a packaging material web and provide feedback to control circuit 316 for use in controlling the rotational angle of packaging material dispenser 300 about pivot axis M.

While dedicated circuit logic may be used in some embodiments, in other embodiments program code executable by a controller may be used to drive motor 314 to balance the forces sensed by load cells 318, 320. Implementation of such program code would be well within the abilities of those of ordinary skill having the benefit of the instant disclosure.

In other embodiments, an electromechanical arrangement may be used to pivot only an exit point or other portion of a packaging material dispenser. In addition, it will be appreciated that different approaches may be combined, e.g., with a mechanically-movable exit roller such as illustrated in FIGS. 6-9 utilized in connection with an electromechanically-controlled packaging material dispenser such as packaging material dispenser 300 of FIG. 10.

Figure 11:
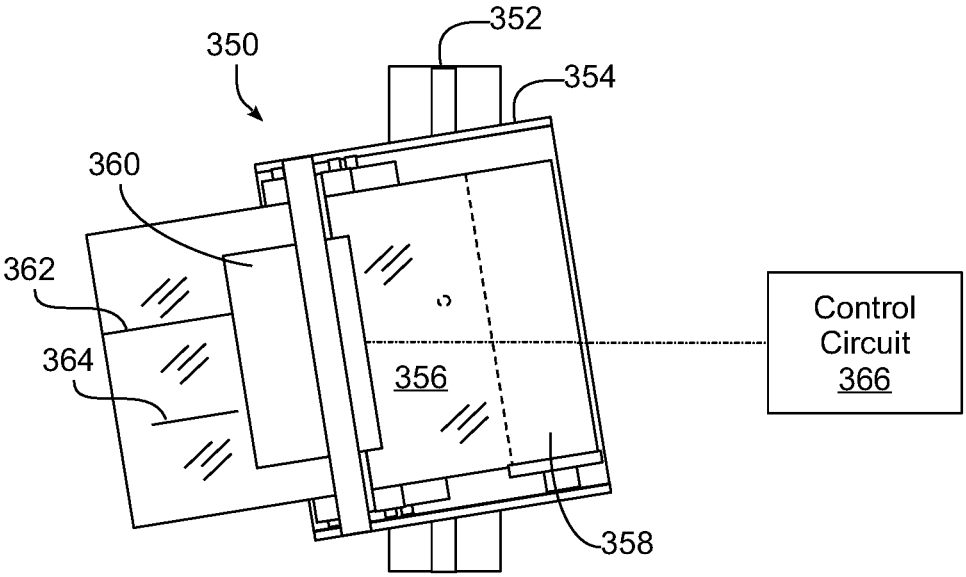
FIG. 11 is a side elevational view of another example implementation of a self-balancing paper-based packaging material dispenser capable of being used in the wrapping apparatus of FIG. 1, and including a cutting mechanism for forming one or more longitudinal slits in a web of paper-based packaging material.

Now turning to FIG. 11, in other embodiments, it may be desirable to form one or more longitudinal slits in a paper-based packaging material to effectively reduce the width of the packaging material web and thereby reduce overall force imbalances between the opposing edges of the overall packaging material web. FIG. 11, in particular, illustrates a paper-based packaging material dispenser 350 mounted for vertical movement on a wrapping apparatus frame 352 and including a support structure 354 that is pivotable in a similar manner to packaging material dispenser 150 of FIGS. 2-5, and that supports a paper-based packaging material web 356 dispensed by a paper-based packaging material roll 358. As noted above, the formation of longitudinal slits may be used in combination with the other paper-based packaging material dispensers discussed herein, or may be used without a self-balancing paper-based packaging material dispenser in other embodiments.

A cutting mechanism 360, e.g., including one or more knives, may be used to form one or more longitudinal slits (e.g., longitudinal slits 362, 364) in packaging material web 356 after the packaging material web exits the packaging material dispenser. In some embodiments, cutting mechanism 360 may be mechanical in nature and operate continuously (e.g., to generate continuous slits such as illustrated by slit 362), while in other embodiments, cutting mechanism 360 may be electromechanical in nature and operate selectively, e.g., under the control of a control circuit 366, to generate selective slits such as illustrated by slit 364. Control circuit 366, for example, may selectively engage cutting mechanism 360 depending upon vertical movement of packaging material dispenser 350 along the axis of rotation for wrapping and/or only for portions of the packaging material web that are proximate the corners of the load. An innumerable number of slit variations may be used in various embodiments, so the invention is not limited to the particular variations discussed herein.

Other embodiments will be apparent to those skilled in the art from consideration of the specification and practice of the present invention. Therefore, the invention lies in the claims set forth hereinafter.

What is claimed is:

1. An apparatus for wrapping a load, comprising:

a self-balancing paper-based packaging material dispenser configured to dispense paper-based packaging material to the load, the self-balancing paper-based packaging material dispenser including an exit point configured to tilt to compensate for a force imbalance between opposing edges of a web of the paper-based packaging material extending between the load and the exit point of the self-balancing paper-based packaging material dispenser; and a rotational drive configured to generate relative rotation between the self-balancing paper-based packaging material dispenser and the load about an axis of rotation;

wherein the self-balancing paper-based packaging material dispenser includes a support structure configured to support a roll of paper-based packaging material, and wherein the support structure is pivotably supported to pivot about a pivot axis that is substantially perpendicular to the axis of rotation; and wherein the apparatus further comprises:

a rotary actuator configured to controllably rotate the support structure about the pivot axis;

at least one sensor configured to sense force exerted on the web of paper-based packaging material; and a control circuit coupled to the rotary actuator and the at least one sensor and configured to drive the rotary actuator in response to the sensed force to controllably rotate the support structure to equalize forces exerted on the opposing edges of the web.

2. The apparatus of claim 1, wherein the exit point comprises an exit idle roller.

3. The apparatus of claim 1, wherein the at least one sensor includes:

a first sensor configured to sense a force exerted on a first edge of the web of paper-based packaging material dispenser; and a second sensor configured to sense a force exerted on a second edge of the web of paper-based packaging material dispenser.

4. The apparatus of claim 3, wherein the exit point comprises an exit idle roller, and wherein the first and second sensors are load cells coupled to first and second ends of the idle roller.

5. An apparatus for wrapping a load, comprising:

a self-balancing paper-based packaging material dispenser configured to dispense paper-based packaging material to the load, the self-balancing paper-based packaging material dispenser including an exit point configured to tilt to compensate for a force imbalance between opposing edges of a web of the paper-based packaging material extending between the load and the exit point of the self-balancing paper-based packaging material dispenser; and a rotational drive configured to generate relative rotation between the self-balancing paper-based packaging material dispenser and the load about an axis of rotation;

wherein the self-balancing paper-based packaging material dispenser includes a support structure configured to support a roll of paper-based packaging material, wherein the exit point is movable relative to the support structure to compensate for the force imbalance between the opposing edges of the web, and wherein the exit point engages the web of the paper-based packaging material substantially throughout a wrapping operation during which the load is wrapped with the paper-based packaging material.

6. The apparatus of claim 5, wherein the exit point comprises an exit idle roller.

7. The apparatus of claim 6, wherein the exit idle roller is pivotably mounted to the support structure to pivot about a roller pivot axis that is substantially perpendicular to an axis of rotation of the roller.

8. The apparatus of claim 6, wherein at least one end of the exit idle roller is coupled to the support structure through a floating coupling.

9. The apparatus of claim 8, wherein the exit idle roller includes an axle and the floating coupling comprises:

a support including a slot through which an end of the axle projects; and a bias mechanism coupled between the support and the end of the axle.

10. The apparatus of claim 6, wherein both ends of the exit idle roller are coupled to the support structure through floating couplings.

11. The apparatus of claim 1, further comprising a lift drive configured to move the self-balancing paper-based packaging material dispenser in a direction generally parallel to the axis of rotation.

12. The apparatus of claim 11, wherein tilting of the exit point to compensate for the force imbalance between the opposing edges of the web reduces puckering of at least one edge of the web when the lift drive is moving the self-balancing paper-based packaging material dispenser while the rotational drive is generating relative rotation between the self-balancing paper-based packaging material dispenser and the load.

13. The apparatus of claim 11, wherein tilting of the exit point to compensate for the force imbalance between the opposing edges of the web reduces puckering of an edge of the web proximate a portion of a load having different girths at different elevations when the lift drive is moving the self-balancing paper-based packaging material dispenser while the rotational drive is generating relative rotation between the self-balancing paper-based packaging material dispenser and the load.

14. The apparatus of claim 1, further comprising a cutting mechanism positioned to form one or more longitudinal slits in the web of paper-based packaging material to reduce the force imbalance between the opposing edges of the web.

15. The apparatus of claim 14, wherein the cutting mechanism is configured to continuously form the one or more longitudinal slits during relative rotation between the load and the self-balancing paper-based packaging material dispenser.

16. The apparatus of claim 14, wherein the cutting mechanism is configured to selectively form the one or more longitudinal slits during relative rotation between the load and the self-balancing paper-based packaging material dispenser.

17. The apparatus of claim 16, wherein the cutting mechanism is configured to selectively form the one or more longitudinal slits when the self-balancing paper-based packaging material dispenser is moving in a direction generally parallel to the axis of rotation.

18. The apparatus of claim 16, wherein the cutting mechanism is configured to selectively form the one or more longitudinal slits when the self-balancing paper-based packaging material dispenser for portions of the web that are proximate corners of the load.

19. An apparatus for wrapping a load, comprising:

a paper-based packaging material dispenser configured to dispense paper-based packaging material to the load;

a rotational drive configured to generate relative rotation between the self-balancing paper-based packaging material dispenser and the load about an axis of rotation; and a cutting mechanism configured to form one or more longitudinal slits in a web of paper-based packaging material extending between an exit point of the paper-based packaging material dispenser and the load to reduce a force imbalance between opposing edges of the web.

20. The apparatus of claim 19, wherein the paper-based packaging material dispenser comprises a self-balancing paper-based packaging material dispenser including an exit point configured to tilt to compensate for a force imbalance between opposing edges of a web of the paper-based packaging material extending between the load and the exit point of the self-balancing paper-based packaging material dispenser, wherein the self-balancing paper-based packaging material dispenser includes a support structure configured to support a roll of paper-based packaging material, and wherein the support structure is pivotably supported to pivot about a pivot axis that is substantially perpendicular to the axis of rotation.

21. The apparatus of claim 20, wherein the support structure further supports a plurality of rollers defining a serpentine path through which paper-based packaging material is dispensed from the roll of paper-based packaging material.

22. The apparatus of claim 20, wherein the support structure is pivotably supported by a low friction support bearing and the pivot axis is positioned proximate a center of gravity of the self-balancing paper-based packaging material dispenser.

23. The apparatus of claim 20, wherein the support structure is freely pivotable about the pivot axis such that a force imbalance between the opposing edges of the web naturally tilts the support structure to equalize forces exerted on the opposing edges of the web.

24. The apparatus of claim 20, further comprising:

a rotary actuator configured to controllably rotate the support structure about the pivot axis;

at least one sensor configured to sense force exerted on the web of paper-based packaging material; and a control circuit coupled to the rotary actuator and the at least one sensor and configured to drive the rotary actuator in response to the sensed force to controllably rotate the support structure to equalize forces exerted on the opposing edges of the web.

25. An apparatus for wrapping a load, comprising:

a self-balancing packaging material dispenser configured to dispense packaging material to the load, the self-balancing packaging material dispenser including an exit point configured to tilt to compensate for a force imbalance between opposing edges of a web of the packaging material extending between the load and the exit point of the self-balancing packaging material dispenser, wherein the self-balancing paper-based packaging material dispenser includes a support structure configured to support a roll of packaging material, and wherein the support structure is pivotably supported to pivot about a pivot axis that is substantially perpendicular to an axis of rotation;

a rotational drive configured to generate relative rotation between the self-balancing packaging material dispenser and the load about the axis of rotation;

a rotary actuator configured to controllably rotate the support structure about the pivot axis;

at least one sensor configured to sense force exerted on the web of packaging material; and a control circuit coupled to the rotary actuator and the at least one sensor and configured to drive the rotary actuator in response to the sensed force to controllably rotate the support structure to equalize forces exerted on the opposing edges of the web.

* * * * *